US006647898B2

(12) United States Patent
Li

(10) Patent No.: US 6,647,898 B2
(45) Date of Patent: Nov. 18, 2003

(54) SPRING ASSISTED APPARATUS FOR RAMP ACTUATING MECHANISM AND MOVABLE DRAFT ARM ARRANGEMENT

(75) Inventor: Wei Li, Pittsburgh, PA (US)

(73) Assignee: Westinghouse Air Brake Technologies Corporation, Wilmerding, PA (US)

( * ) Notice: Subject to any disclaimer, the term of this patent is extended or adjusted under 35 U.S.C. 154(b) by 0 days.

(21) Appl. No.: 10/216,581

(22) Filed: Aug. 9, 2002

(65) Prior Publication Data

US 2003/0110975 A1 Jun. 19, 2003

Related U.S. Application Data

(60) Provisional application No. 60/340,279, filed on Dec. 14, 2001, and provisional application No. 60/340,577, filed on Dec. 14, 2001.

(51) Int. Cl.[7] ..... B61C 17/00

(52) U.S. Cl. ..... 105/458; 414/480; 414/537

(58) Field of Search ..... 105/458; 213/75 R, 213/75 TC, 211, 212; 414/480, 537

(56) References Cited

U.S. PATENT DOCUMENTS

| | | | | | |
|---|---|---|---|---|---|
| 544,561 | A | | 8/1895 | Bridegum | |
| 3,840,127 | A | * | 10/1974 | Edwards et al. | 213/75 TC |
| 4,219,123 | A | * | 8/1980 | Saeki | 213/75 TC |
| 4,456,413 | A | | 6/1984 | Pavlick | |
| 4,652,057 | A | | 3/1987 | Engle et al. | |
| 4,686,907 | A | | 8/1987 | Woollam et al. | |
| 4,718,351 | A | | 1/1988 | Engle | |
| 4,718,800 | A | | 1/1988 | Engle | |
| 4,750,431 | A | | 6/1988 | Yates et al. | |
| 4,805,539 | A | | 2/1989 | Ferris et al. | |
| 4,973,206 | A | | 11/1990 | Engle | |
| 5,020,445 | A | | 6/1991 | Adams, Jr. | |
| 5,036,774 | A | | 8/1991 | Curtis et al. | |
| 5,094,583 | A | * | 3/1992 | Bills et al. | 414/537 |
| 5,207,161 | A | | 5/1993 | Pileggi et al. | |
| 5,216,956 | A | | 6/1993 | Adams, Jr. | |
| 5,222,443 | A | | 6/1993 | Engle | |
| 5,246,081 | A | | 9/1993 | Engle | |
| 5,340,267 | A | * | 8/1994 | Stoll et al. | 414/537 |
| 5,564,341 | A | | 10/1996 | Martin | |
| 5,651,656 | A | | 7/1997 | Hapeman | |
| 5,697,754 | A | * | 12/1997 | Raymer | 414/537 |
| 5,722,736 | A | | 3/1998 | Cook | |
| 5,733,091 | A | * | 3/1998 | Long | 414/537 |
| 5,816,767 | A | * | 10/1998 | Mann | 414/537 |
| 6,394,734 | B1 | * | 5/2002 | Landoll et al. | 414/480 |
| 6,431,815 | B1 | * | 8/2002 | Zarzecki et al. | 414/537 |

* cited by examiner

*Primary Examiner*—Mark T. Le
*Assistant Examiner*—Lars A. Olson
(74) *Attorney, Agent, or Firm*—Buchanan Ingersoll, P.C.

(57) ABSTRACT

A ramp actuating mechanism for a rail vehicle having a movable ramp and a movable draft arm and coupler arrangement, wherein a spring assisted apparatus can be associated with the movable draft arm and coupler arrangement to counterbalance the load of the movable draft arm and coupler arrangement.

4 Claims, 6 Drawing Sheets

SPRING ASSISTED APPARATUS FOR RAMP ACTUATING MECHANISM AND MOVABLE DRAFT ARM ARRANGEMENT

CROSS-REFERENCE TO RELATED APPLICATIONS

This application claims priority to copending U.S. patent application Ser. No. 09/255,204, and U.S. Provisional Patent Applications Ser. Nos. 60/340,279, and 60/340,577 both filed Dec. 14, 2001.

BACKGROUND

The present invention relates generally to a ramp actuating mechanism for a rail vehicle having a ramp and a movable draft arm and coupler arrangement, and more particularly to a ramp actuating mechanism including a spring assisted lifting apparatus for the movable draft arm and coupler arrangement.

The invention is especially suited for a ramp car rail vehicle as described in Applicant's related patent applications mentioned above. As described in those patent applications, the ramp car rail vehicle can be designed for ease of loading and unloading freight from trains, especially freight in the form of semi-trailers. Conventionally, semi-trailers typically can be loaded on, and unloaded from, rail vehicles only at special railroad terminals equipped with special lifting equipment. However, a ramp car rail vehicle having a ramp and a movable draft arm and coupler arrangement would permit loading and unloading of semi-trailers without such special lifting equipment. This would enable railroads to provide transportation services to shippers far away from such specially equipped terminals. Such ramp car rail vehicles can be equipped with deployable ramps, allowing the semi-trailers to be loaded on, or unloaded from, rail cars at any location accessible to the ramp, such as at grade crossings or in classification yards. As described in Applicant's aforementioned copending patent applications, such a ramp car rail vehicle can also be configured for use in an integral/semi-integral train employing a segmented roll-on/roll-off freight loading/unloading system. Generally, in such trains multiple rail vehicles can be articulated together, forming segments of an integral train for carrying freight, particularly semi-trailers, wherein each such train segment can have an integrated arrangement composed of different types of rail vehicles.

SUMMARY

A ramp raising apparatus for a rail vehicle can include a ramp and a movable draft arm and coupler arrangement having a spring assisted apparatus associated with the movable coupler and draft arm arrangement. The spring assisted apparatus can counterbalance the load of the ramp and movable draft arm and coupler lifting arrangement to reduce raising and lowering impacts of the ramp. The spring assisted mechanism can also reduce the operating air pressure otherwise required to raise and lower the ramp, thereby enabling reduced consumption of pressurized air per cycle of operation.

BRIEF DESCRIPTION OF THE DRAWING FIGURES

DETAILED DESCRIPTION OF CERTAIN EMBODIMENTS

Figure 1:
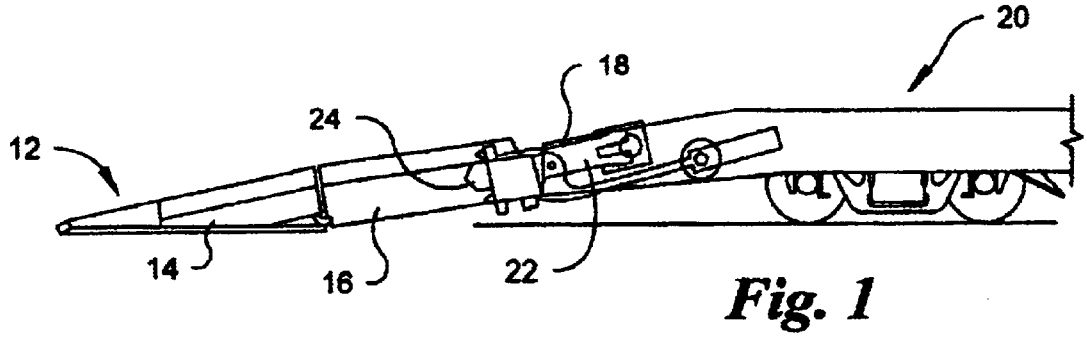
FIGS. 1 through 3 are side views, partially in section, showing a ramp member and a movable coupler and draft arm arrangement, wherein the ramp member is illustrated in lowered, partially retracted, and fully retracted positions, respectively.
Figure 2:
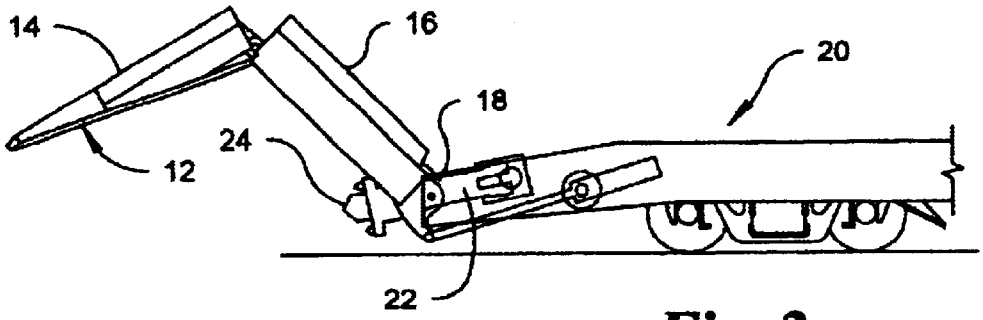
Figure 3:
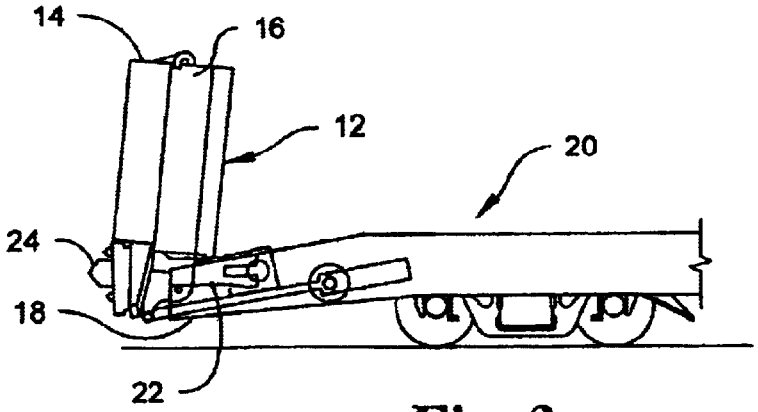
Figure 4:
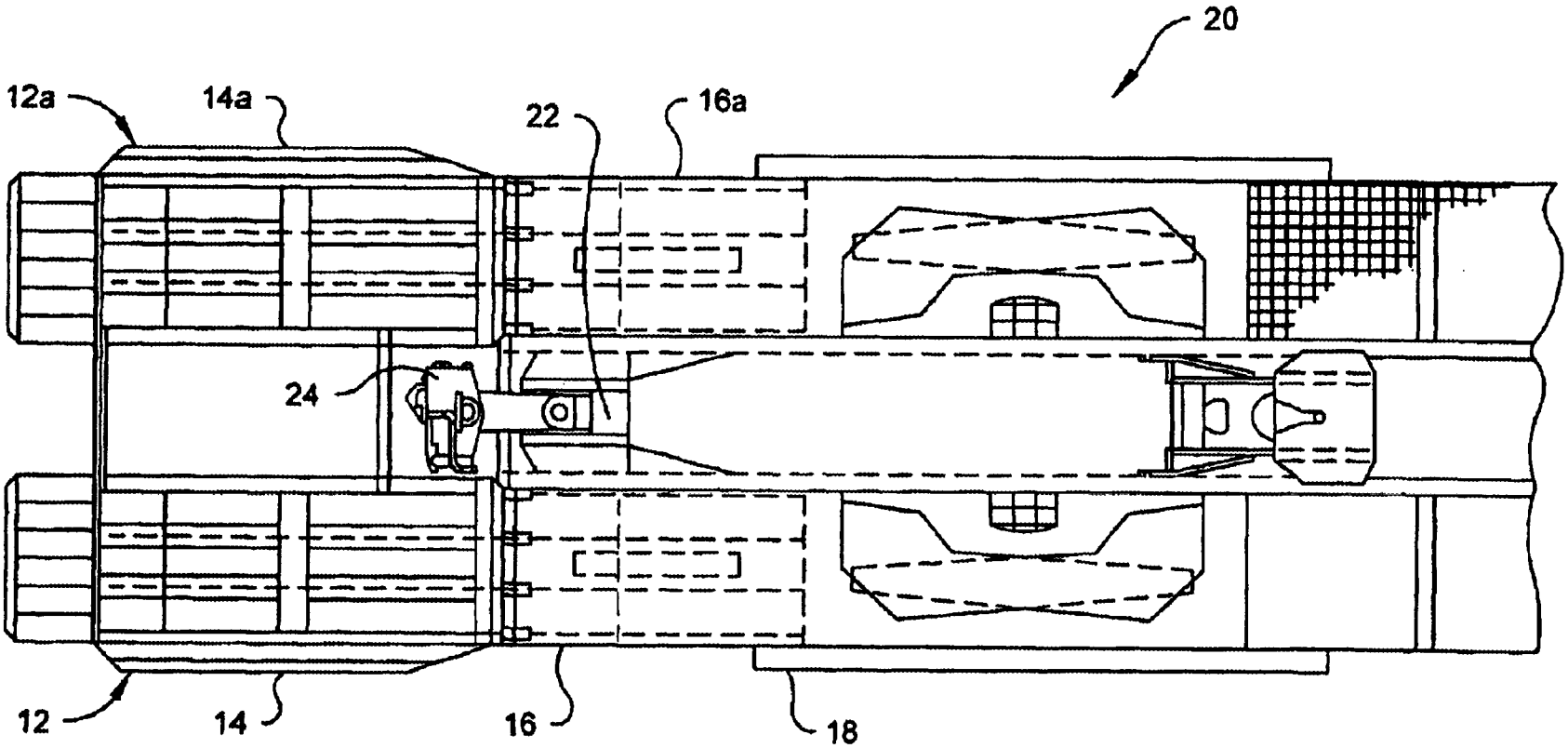
FIG. 4 is a top view of the ramp shown in FIG. 1.

Rail vehicles having ramps are known in the art. For example, one prior art ramp design includes a pair of ramps, each of which is mounted to a wheel set. The ramps extend towards each other and are locked to each other in the travel position. Another example includes multiple ramp sections and utilizes gear type mechanisms and hydraulic actuators for deployment and folding of the multiple ramp sections. Also, in Applicant's aforementioned United States patent applications, different embodiments of ramp designs are described. One such embodiment is shown in FIGS. 1 through 4, wherein the ramp comprises a pair ramp members 12, 12*a* positioned at opposite sides of the rail vehicle 20, with a movable draft arm 22 and coupler 24 arrangement disposed therebetween. Each ramp member 12, 12*a* is made of a pair of pivotally connected ramp sections 14, 14*a*, 16, 16*a*. One end of each ramp member 12, 12*a* is also pivotally connected to the frame of the rail vehicle. The pivotally connected double ramp sections 14, 14*a*, 16, 16*a* permit the ramp members 12, 12*a* to fold relatively compactly when raised. The draft arm 22 and coupler 24 arrangement are designed to move up and down simultaneously with the raising and lowering of the ramp members 12, 12*a* so that the coupler 24 does not interfere with loading and unloading the rail vehicle 20 via the ramp members 12, 12*a*, as explained in detail in one or more of Applicant's aforementioned copending patent applications.

Figure 5:
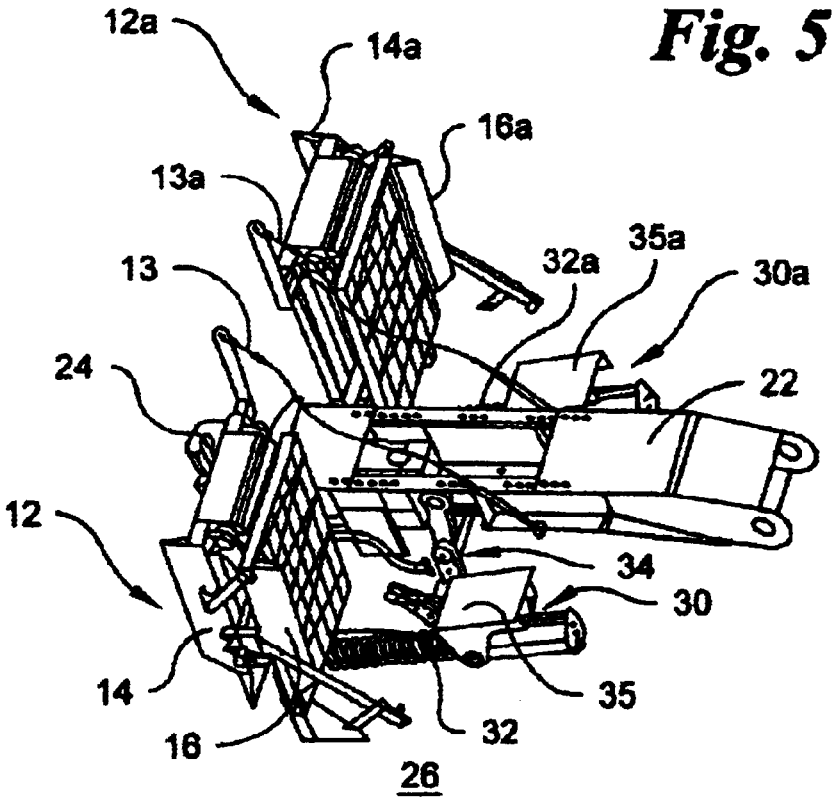
FIG. 5 is a perspective view of an embodiment of a ramp actuating mechanism for a ramp and movable draft arm and coupler arrangement.
Figure 6:
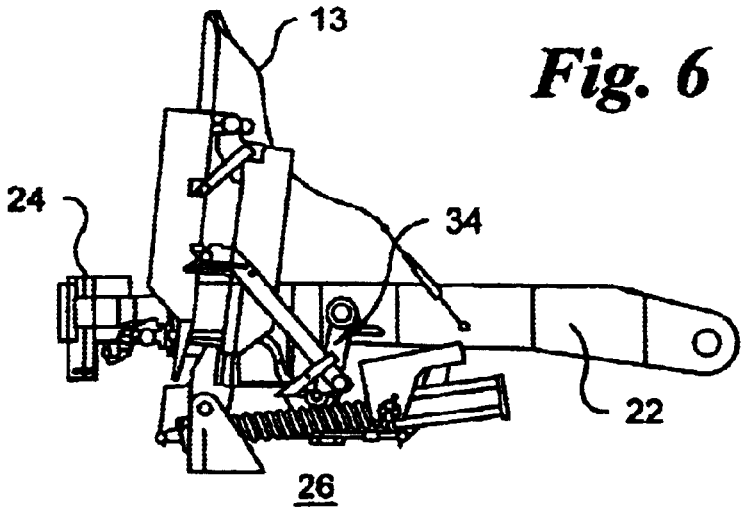
FIG. 6 is a side view of the embodiment shown in FIG. 5.

Referring now to FIGS. 5 and 6, an embodiment of a ramp actuating mechanism 26 is illustrated for raising and lowering the movable draft arm 22 and coupler 24 arrangement while raising and lowering ramp members 12, 12*a*. Where, such as in this case, the ramp comprises pair ramp members 12, 12*a* having two pivotally connected sections 14, 14*a*, 16, 16*a*, lowering and raising the ramp may be described more aptly as extending and retracting, or deploying and folding. The ramp actuating mechanism 26 shown can be operated by a pair of fluid pressure, or electrically, activated members. These members can be double acting cylinders 30, 30*a*, and can operate pneumatically, hydraulically, or electrically. Each cylinder 30, 30*a* can be associated with a respective jointed ramp member 12, 12*a*. Where the cylinders 30, 30*a* are pneumatically operated, compressed air can be supplied from the brake pipe on the rail vehicle. Alternatively, a separate source of compressed air could be used. The ramp actuating mechanism 26 can be relatively uncomplicated, and need not employ expensive mechanical elements such as gears. The ramp actuating mechanism 26 can be easily operated, and the ramp members 12, 12*a* can be deployed and retracted in a relatively short period of time.

The ramp members 12, 12*a* can be efficiently counterbalanced throughout an operating angle of over 90 degrees by the double acting cylinders 30, 30*a*, which are mounted on the end of the frame 18, at either side of the rail vehicle 20. One double acting cylinder 30, 30*a* is associated with each of the two ramp members 12, 12*a*. At the full up, or folded, position, the center of gravity of the folded ramp members 12, 12*a* is designed to be slightly inboard of the pivot points of each ramp member 12, 12*a* with respect to the frame 18 of the rail vehicle 20, thus creating a torque which urges the ramp members 12, 12*a* to fold back toward the deck of the rail vehicle 20. Tethering members 13, 13*a* can be provided, which can be manually engaged/disengaged, so that the ramp members 12, 12*a* cannot be re-deployed unless and until the tethering members 13, 13*a* are manually disengaged. Also, positive stops could be provided on the sides of the ramp members 12, 12*a* and/or the frame 18 of the rail vehicle 20 to prevent further folding once the ramp members 12, 12*a* are fully retracted to the stored position.

To deploy the ramp members 12, 12*a*, the tethering members 13, 13*a* can be manually disengaged and the double acting cylinders 30, 30*a* can be actuated, such as by introducing compressed air into the cylinders, to overcome the torque urging the ramp members 12, 12*a* to remain in the folded position. Once the ramp members 12, 12*a* begin unfolding, the unbalanced portion of the weight of the ramp members 12, 12*a* will tend to lengthen the double acting cylinders 30, 30*a* and unfold the ramp members 12, 12*a* into the fully extended loading position. Where the cylinders 30, 30*a* are pneumatically operated, the speed of this operation can be easily controlled by choking the exhaust of air from the cylinders 30, 30*a*. Air for operation of the double acting cylinders 30, 30*a* can be supplied from a dedicated reservoir (not shown) which can be provided on the rail vehicle 20, or from a separate source. Where a reservoir is utilized, it can be charged from a main reservoir on a locomotive when the train is coupled. This reservoir can be sized to permit at least two operations of the ramp members 12, 12*a* from an initial charge of 130 psi. Provision can also be made to take air from a hostler tractor for this operation without requiring the hostler to charge any other part of the train's pneumatic system.

Several difficulties can be encountered in the design of such a ramp actuating mechanism 26 which need to be addressed to obtain the desired performance during raising and lowering operations. For example, the ramp members 12, 12*a* are located on an end of the rail vehicle 20, requiring the movable draft arm 22 and coupler 24 to be lowered and raised in along with the ramp members 12, 12*a*. Since both the draft arm 22 and the coupler 24 are relatively heavy, the difficulty of operating and controlling the ramp actuating mechanism 26 is more difficult. Also, the ramp members 12, 12*a* and the movable draft arm 22 and coupler 24 arrangement are spaced relatively far apart, and can thus require lengthy linkages to connect them together to the ramp actuating mechanism 26. Constraints related to the limited space under the rail vehicle 20 and within the railroad clearance envelope therefore makes the design of the ramp actuating mechanism 26 and power transmission from the pneumatic actuators more difficult. Additionally, pneumatic control uses air, which is compressible and makes accurate motion control more difficult to achieve. Moreover, the compressed air is preferably supplied from the brake pipe, wherein the pressure can fall as low as 70 psi. Even with limited air storage near the ramp members 12, 12*a*, the ramp members 12, 12*a* preferably will preferably be capable of being operated twice under the worst case air pressure condition. Therefore, a design that requires less air is important. Furthermore, operation requirements are stringent—the ramp members 12, 12*a* must be easy to operate, preferably one operation each for deploying and retracting—each operation can preferably be completed in about 30 seconds, or less. Other difficulties can include impermissible interference with other train operations, such as brake system and coupling of cars, folding of the ramp members 12, 12*a* in a stable and safe position for travel, and stringent environmental requirements, such as operating temperature, and shock and vibration requirements.

Tests of the ramp actuating mechanism 26 shown in FIGS. 5 and 6 revealed that the performance left room for improvement. During testing, the ramp members 12, 12*a*, and the movable draft arm 22 and coupler 24 arrangement was lowered and raised, but the ramp members 12, 12*a* experienced impacts, between the ramp members 12, 12*a* and the ground, which sometimes were severe. The operating air pressure also tended to be higher than desirable.

Figure 7:
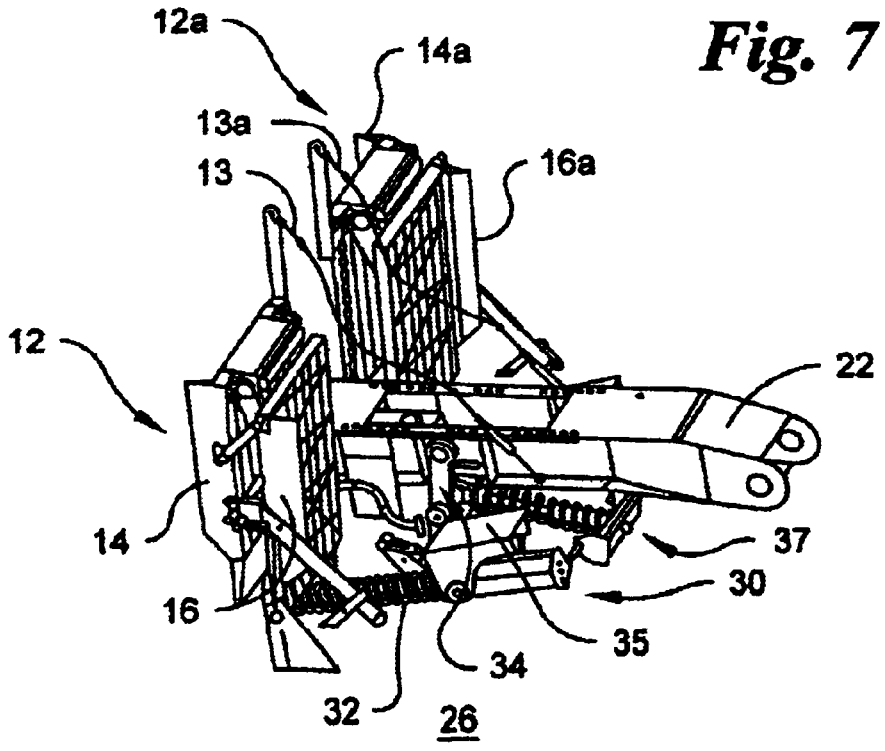
FIG. 7 is a perspective view of a presently preferred embodiment of a ramp actuating mechanism for a ramp and movable draft arm and coupler arrangement including a spring assisted apparatus associated with the movable draft arm and coupler arrangement.
Figure 8:
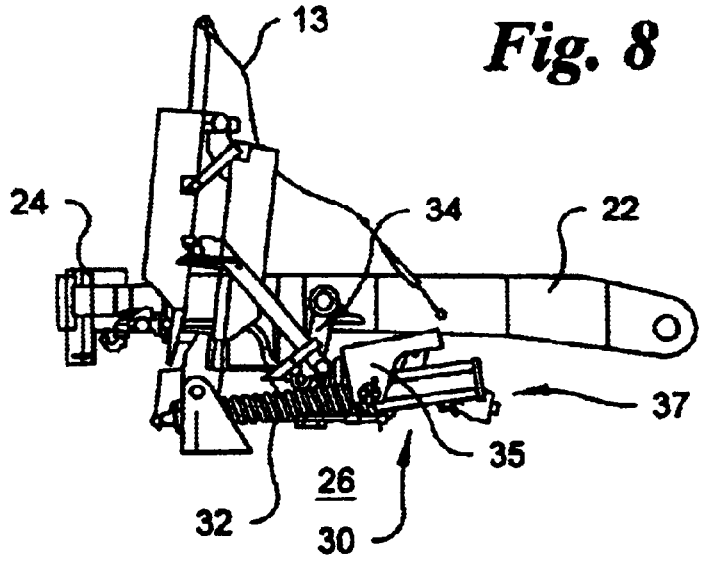
FIG. 8 is a side view of the embodiment shown in FIG. 7.

FIGS. 7 and 8 illustrate an embodiment of a spring assisted apparatus 37 associated with the movable draft arm 22 and coupler 24 arrangement. The spring assisted apparatus 37 is connected to the knee linkage 34 and works in conjunction with the ramp actuating mechanism 26. As the double acting cylinders 30, 30*a* are actuated to move the ramp members 12, 12*a*, the knee linkage 34 is moved, via a system of linkages which will be described in more detail below in connection with FIG. 11, thereby raising or lowering the movable draft arm 22 and coupler 24 arrangement simultaneously with the ramp members 12, 12*a*. The spring assisted apparatus 37 can eliminate, or substantially reduce the severity of, ramp member 12, 12*a* impacts against the ground. Additionally, the required operating air pressure can also be reduced. The spring assisted apparatus 37 can be designed to bias the ramp members 12, 12*a*, and the movable draft arm 22 and coupler 24 arrangement towards a stable folded position for travel.

Figure 9:
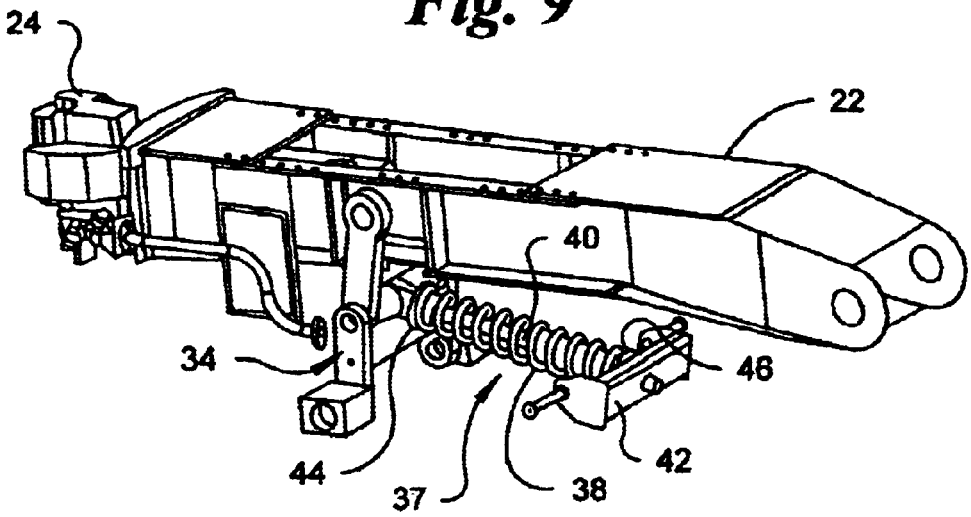
FIG. 9 is a perspective view showing only the spring assisted apparatus associated with the movable draft arm and coupler arrangement.
Figure 10:
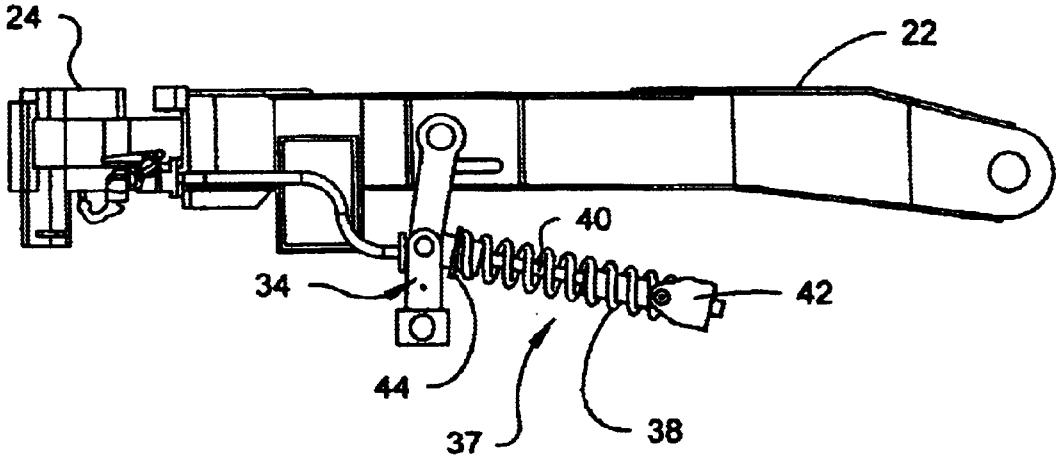
FIG. 10 is a side view of the spring assisted apparatus and movable draft arm and coupler arrangement shown in FIG. 9.

Referring to FIGS. 9 and 10, a less obstructed view of an embodiment of the spring assisted apparatus 37 is shown, which assists the ramp actuating mechanism 26 in raising and lowering the associated movable draft arm 22 and coupler 24 arrangement. The spring assisted apparatus 37 can include a resiliently compressible member, such as a compression spring 38, a rod assembly 40, and a bracket assembly 42. The rod 40 and bracket 42 assemblies can each include a spring seat 44, 46, respectively, to support and guide the compression spring 38. One end of the rod assembly 40 can be attached to the bracket assembly 42 via a sliding joint connection, whereas the other end can be pivotally connected to the knee linkage 34. The bracket assembly 42 can be attached to the frame 18 of the rail vehicle 20. Each end of the rod 40 assembly is pivotably connected between the bracket assembly and the frame 18 of the rail vehicle 20, which gives the rod assembly 40 freedom to always axially align with the reacting force of the compression spring 38, which helps prevent buckling and uneven loading from occurring. As can be understood, the spring assisted apparatus 37 will be at a different angle to the knee linkage 34 at each position throughout the range of movement of the movable draft arm 22 and coupler 24 arrangement. Consequently, different amounts of spring force, as measured at the rod ends of the double acting cylinders 30, 30*a*, will be transmitted to the knee linkage 34 to counterbalance the ramp members 12, 12*a* and the movable draft arm 22 and coupler 24 arrangement through the entire range of movement.

Figure 11:
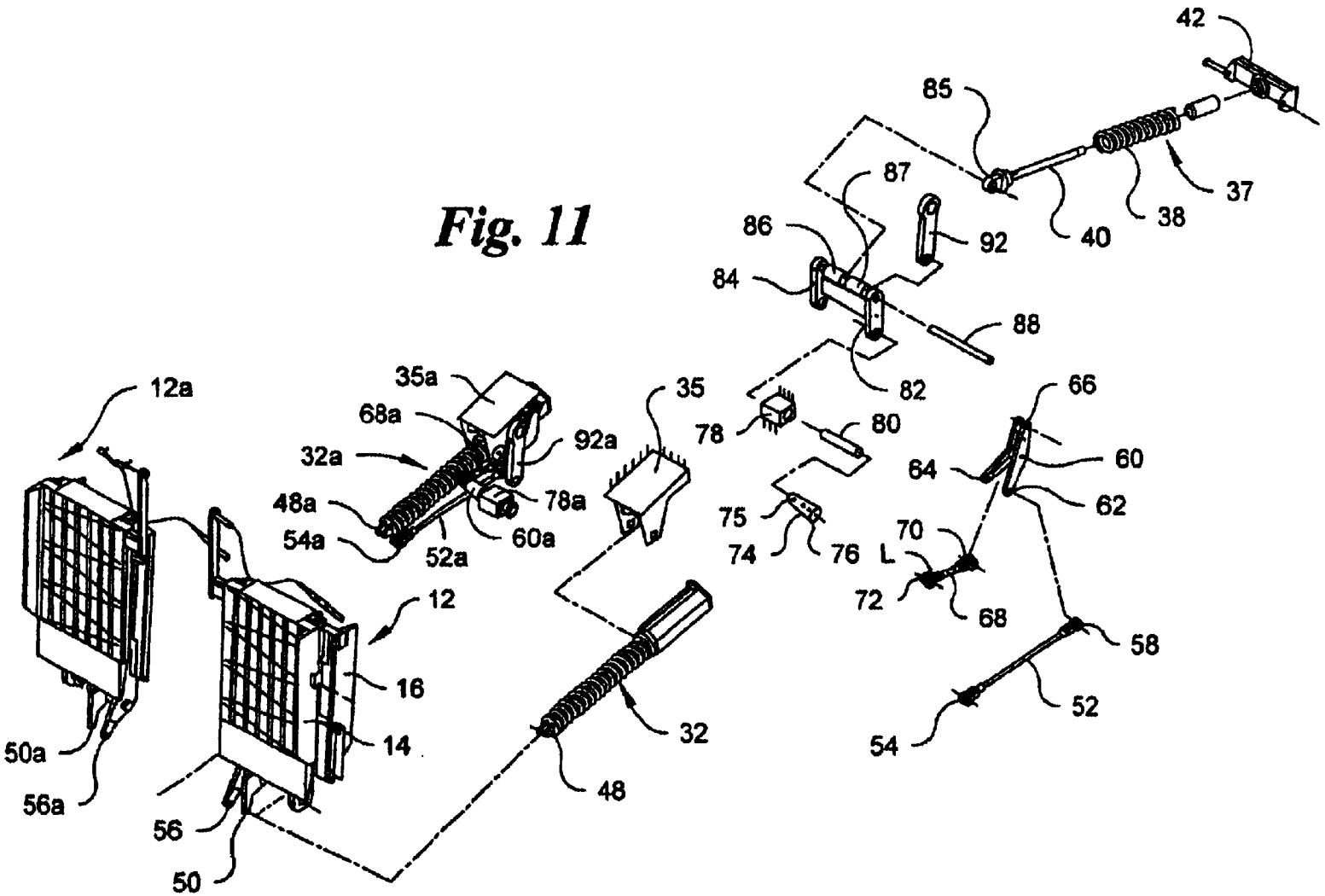
FIG. 11 is an exploded view illustrating the linkages which transmit force to the spring assisted apparatus.

The manner of force transmission from the double acting cylinders 30, 30*a* to the knee linkage 34 can be more fully understood from FIG. 11, wherein an embodiment of a system of linkages is illustrated.

As shown, the clevis end 48, 48*a* of each double acting air cylinder 32, 32*a* can be pivotably connected to an outer extension arm 50, 50*a* from each of the ramp members 12, 12*a*. For sake of convenience, the following description will refer to linkages on the right side of FIG. 11, but it is to be understood that a mirror image linkage system is also provided in connection with the ramp member 12*a* on the left side of FIG. 11. As shown, a main coupler rod 52 has a first end 54 pivotally connected to an inner extension arm on the lower end of the ramp member 12, and a second end 58 pivotally connected to a bell crank 60. The bell crank 60 has first 62 and second 64 lower arms and an upper arm 66. The upper arm 66 can be pivotally connected to the frame of the rail car. The second end 58 of the main coupler rod 52 can be pivotally connected to the first lower arm 62 of the bell crank 60. A secondary coupler rod 68 can have a first end 70 connected to the second lower arm 64 of the bell crank 60 and a second end 72 connected to the upper end 75 of an input lever 74. The input lever 74 can have a lower end 76 pivotally connected to a pivot block 78, which can be rigidly connected to the frame 18 of the rail vehicle 20. The lower end 76 of the input lever 74 is connected to the pivot block 78 via a shaft 80. The lower end 76 of the input lever 74 can be keyed to one end of the shaft 80. The shaft 80 extends through the pivot block 78 and opposite ends of the shaft 80 can be connected to opposing arms 82 and 84 on the knee linkage 34. The opposing arms 82 and 84 of the knee linkage 34 can also be keyed to the ends of the shaft 80, just as the lower end 76 of the input lever 74. Accordingly, rotation of the input lever 74 results in rotation of the shaft 80 which in turn causes rotation of the knee linkage 34 via the arms 82 and 84.

The rod end 85 of the rod assembly 40 of the spring assisted apparatus 37 can be pivotally connected to a shaft 88 which is disposed through an upper end of the arms 82 and 84 of the knee linkage 34. A pair of bushings 86, 87 can be provided on either side of the rod end 86 of center the rod assembly 40 between the arms 82, 84 of the knee linkage 34. The knee linkage 34 can also include opposing hip linkages 90, 92, which can have lower ends pinned to the shaft 80 and upper ends pivotally connectable to the movable draft arm 22 and coupler 24 arrangement.

In accordance with the system of linkages just described, movement of the double acting cylinder 32 results in movement of the ramp member 12 via outer extension arm 50. Main coupling rod 52 moves correspondingly due to the connection of the first end 54 of the main coupler rod 52 to the inner extension arm 56 on the ramp member 12. Movement of main coupler rod 52 causes rotation of the bell crank 60 about the point where the upper arm 66 of the bell crank 60 is connected to the frame 18 of the rail car 20. Rotation of the bell crank 60 thus causes movement of the secondary coupler rod 68, which has one end 70 pivotally connected to the second lower arm 64 of the bell crank 60. Since the opposite end 72 of the secondary coupler rod 68 is connected to the upper end 75 of the input lever 74, the input lever 74 is caused to rotate which, in turn, rotates the shaft 80 to which the lower end 76 of the input lever 74 is keyed. Since the lower ends of the opposing arms 82, 84 of the knee linkage 34 are keyed to shaft 80, rotating the input lever results in rotation of the knee linkage 34. In this manner, activation of the double acting cylinders 32, 32*a* causes both the ramp portions 12, 12*a* and the movable draft arm 22 and coupler 24 arrangement to move simultaneously via the knee linkage 34, movement of which also activates the spring assisted apparatus 37.

In the deployed, or loading, position, where force from the spring assisted apparatus 37 is generally not needed, the angle between the spring assisted apparatus 37 and the knee linkage 34 is nearly zero, and almost all the spring force is stored in the knee linkage 34. As the ramp members 12, 12*a* are retracted from the extended position, the angle between the spring assisted apparatus 37 and the knee linkage 34 increases, as does the spring force transmitted by the spring assisted apparatus 34 to the knee linkage 34. The transmitted spring force reaches a maximum at a point where the knee linkage 34 is fully extended, or nearly so, and then decreases as the ramp members 12, 12*a*, and the movable draft arm 22 and coupler 24 arrangement, move towards the fully raised travel position. The decrease in spring force is due to the fact that the compression spring 38 becomes less compressed as the movable draft arm 22 and coupler 24 arrangement moves towards the full up position. This occurs because the knee linkage 34 moves beyond the fully extended position, thereby lengthening the compression spring 38. However, even in the stored travel position there is still a small amount of deflection left in the compression spring 38, preferably about one inch. This residual spring force biases the knee 34 and the hip linkages 35, 35*a* toward a stable position, safe for travel.

The effective spring force transmitted by the spring assisted apparatus 37 to do work can be adjusted, based on the weights of the ramp members 12, 12*a*, the weight of the movable draft arm 22 and coupler 24 arrangement, and the design of the spring assisted apparatus 37. This can be accomplished, for example, by a combination of changing the application angle between the spring assisted apparatus 37 and the knee linkage 34, the compression spring 38 free length and stiffness, and the preload in the compression spring 38.

Testing of the spring assisted apparatus shown in FIGS. 8 through 11 indicates that raising and lowering impacts of the ramp members 12, 12*a* during operation were nearly eliminated. The operating air pressure was also significantly reduced.

To make the spring assisted apparatus 37 easy to install, the end of the rod assembly 40 can be cut with standard thread. A standard nut can be used to pre-compress the compression spring 38 to allow the mounting bracket assembly 42 to be installed to the frame 18 of the rail vehicle 20. The nut can simply be removed after installation.

Although certain embodiments of the invention have been described in detail, it will be appreciated by those skilled in the art that various modification to those details could be developed in light of the overall teaching of the disclosure. Accordingly, the particular embodiments disclosed herein are intended to be illustrative only and not limiting to the scope of the invention which should be awarded the full breadth of the following claims and any and all embodiments thereof.

What is claimed is:

1. A ramp actuating apparatus for a rail vehicle having a ramp movable between deployed and stored positions and a draft arm and coupler arrangement movable between lowered and raised positions, said ramp actuating apparatus comprising:

a. a first portion connected to said ramp and controllable to move said ramp between said deployed and stored positions;

b. a second portion coupled to said first portion and to said draft arm and coupler arrangement, said second portion having a resiliently compressible member;

c. said first portion causing said second portion to move said draft arm and coupler arrangement to said lowered position when said first portion moves said ramp to said deployed position, and said first portion causing said second portion to move said draft arm and coupler arrangement to said raised position when said first portion moves said ramp to said stored position, d. said second portion having a first end connectable to said rail vehicle and a second end connectable to said coupler and draft arm arrangement via a knee linkage;

e. said knee linkage connected intermediate said coupler and draft arm arrangement and said first portion; and f. said resiliently compressible member positioned intermediate said first and second ends.

2. The ramp actuating apparatus of claim 1 further comprising:

a. said ramp being a pair of ramp members; and b. said first portion having a pair of double acting members, a respective one of said pair of double acting members connected to a respective one of said pair of ramp members, said pair of double acting members controllable to move of said pair of ramp members between said deployed and stored positions.

3. The ramp actuating apparatus of claim 1 further comprising said resiliently compressible member being compressed to a maximum degree when movable draft arm and coupler arrangement is moved to a running position, said running position corresponding to said stored position of said ramp.

4. The ramp actuating apparatus of claim 1 further comprising said knee linkage having upper and lower arms pivotably connected at a point coincident with said second end of said second portion, said upper and lower arms movable relative to each other through a range of motion wherein said upper and lower arms are parallel to each other when said movable draft arm and coupler arrangement is raised to a highest point and at an angle to each other when said movable draft arm and coupler arrangement is at one of said running position and said lowered position, said knee linkage being in an overbalanced condition at said running position corresponding to said resiliently compressible member being compressed via rotation of said knee linkage past said parallel position of said upper and lower arms; wherein said movable draft arm and coupler arrangement is biased in said running position until a force sufficient to overcome said overbalanced condition is applied.

* * * * *